US012655856B2

(12) United States Patent
Maurischat

(10) Patent No.: US 12,655,856 B2
(45) Date of Patent: Jun. 16, 2026

(54) CONVEYING DEVICE FOR CONVEYING A LIQUID/GAS MIXTURE TAKEN FROM A BOREHOLE

(71) Applicant: LEISTRITZ PUMPEN GMBH, Nuremberg (DE)

(72) Inventor: Roland Maurischat, Nuremberg (DE)

(73) Assignee: LEISTRITZ PUMPEN GMBH, Nuremberg (DE)

( * ) Notice: Subject to any disclaimer, the term of this patent is extended or adjusted under 35 U.S.C. 154(b) by 124 days.

(21) Appl. No.: 18/649,572

(22) Filed: Apr. 29, 2024

(65) Prior Publication Data

US 2024/0369077 A1 Nov. 7, 2024

(30) Foreign Application Priority Data

May 4, 2023 (DE) ..... 10 2023 111 632.0

(51) Int. Cl.
*F04F 3/00* (2006.01)
*E21B 41/00* (2006.01)
(Continued)

(52) U.S. Cl.
CPC ..... *F04F 3/00* (2013.01); *E21B 41/00* (2013.01); *E21B 43/121* (2013.01);
(Continued)

(58) Field of Classification Search
CPC ..... E21B 41/00; E21B 43/121; E21B 43/124; F04F 3/00; F04F 5/24; F04F 5/44; F04F 5/46; Y10T 137/86035; Y10T 137/86075
(Continued)

(56) References Cited

U.S. PATENT DOCUMENTS 2,475,918 A * 7/1949 Ruth ..... F04D 13/16 137/565.22
2,757,047 A * 7/1956 Friedmann ..... A01C 23/042 137/892

(Continued)

FOREIGN PATENT DOCUMENTS

DE 240236 A1 10/1986
DE 3622995 A1 2/1987
DE 60021420 T2 4/2006

OTHER PUBLICATIONS

German Patent and Trademark Office issued an Office Action on May 28, 2024 regarding parallel German Patent Application No. DE 10 2023 111 632.0, 7 Pages.

*Primary Examiner* — William M Mccalister
(74) *Attorney, Agent, or Firm* — LUCAS & MERCANTI, LLP; Klaus P. Stoffel

(57) ABSTRACT

A conveying device for conveying a liquid/gas mixture, in particular a crude-oil/natural-gas mixture, taken from a borehole, having a multiphase-pumping device, which can be or is coupled to a feed line and a discharge line and to which the liquid/gas mixture can be fed as a feed flow, via the feed line and via which the mixture can be discharged under increased pressure as a conveyance flow, into the discharge line, and having a recirculation line, via which a sub-flow of the liquid contained in the conveyance flow can be returned to the feed flow. The recirculation line contains an injector, through which the sub-flow is conducted, with a negative pressure being generated in the process, and which can be or is coupled to a gas line, which conducts a gas taken from the borehole. The negative pressure causes the gas to be taken in by suction.

14 Claims, 3 Drawing Sheets

(51) Int. Cl.
*E21B 43/12* (2006.01)
*F04F 5/24* (2006.01)
*F04F 5/44* (2006.01)
*F04F 5/46* (2006.01)

(52) U.S. Cl.
CPC ..... *E21B 43/124* (2013.01); *F04F 5/24* (2013.01); *F04F 5/44* (2013.01); *F04F 5/46* (2013.01)

(58) Field of Classification Search
USPC ..... 137/565.17, 565.22
See application file for complete search history.

(56) References Cited

U.S. PATENT DOCUMENTS 2,800,860 A * 7/1957 Heath ..... F04D 13/16 137/565.17
2,962,048 A * 11/1960 Virgil ..... A47L 15/4219 137/565.17
3,730,646 A * 5/1973 Affri ..... F04F 5/46 417/89
4,471,907 A * 9/1984 Gerstmann ..... F24D 3/10 237/66
4,705,114 A 11/1987 Schroeder
5,199,496 A * 4/1993 Redus ..... E21B 43/017 166/372
6,305,216 B1 10/2001 Samaroo
6,966,367 B2 * 11/2005 Butler ..... E21B 21/001 166/105.5
7,063,161 B2 * 6/2006 Butler ..... F04F 5/24 166/372
7,178,592 B2 * 2/2007 Chitty ..... E21B 21/063 417/313
2011/0223039 A1 * 9/2011 Fang ..... F04D 31/00 417/54
2014/0246095 A1 * 9/2014 Ellis ..... F04B 23/08 137/565.29
2017/0175731 A1 * 6/2017 Abrol ..... F04B 49/06
2022/0102742 A1 * 3/2022 Hero ..... H01M 8/04164

* cited by examiner

CONVEYING DEVICE FOR CONVEYING A LIQUID/GAS MIXTURE TAKEN FROM A BOREHOLE

CROSS-REFERENCE TO RELATED APPLICATIONS

The present application claims priority of DE 10 2023 111 632.0, filed May 4, 2023, the priority of this application is hereby claimed, and this application is incorporated herein by reference.

BACKGROUND OF THE INVENTION

The invention relates to a conveying device for conveying a liquid/gas mixture, in particular a crude-oil/natural-gas mixture, taken from a borehole.

The mining of fluid or gaseous mineral resources such as crude oil and natural gas is done via a borehole, via which the deposit is drilled. If conveyance from an oil well is performed, then, first of all, the crude oil or a crude-oil/natural-gas mixture is conveyed, this mixture being conveyed by means of a multiphase-pumping device connected to the central oil line. This is accompanied by a natural gas, which is usually present at the deposit, being taken from the borehole, the gas being conveyed upward in an external well casing. The external well casing is defined by the actual well in which the central oil line extends, wherein the external well casing surrounds the oil line. The natural gas from the external well casing is usually burnt off, or flared. This is advantageous in particular in the case of relatively old oil wells since the pressure in the external well casing can thereby be reduced, which in turn, since the volume of crude oil is subjected to the gas pressure, has an advantageous effect on the crude-oil conveyance. This is because it is thereby possible for the pressure in the external well casing to be lowered to a level below the level of pressure in the actual oil line.

Not least for environmental reasons, burning off—or flaring—is no longer desirable, or allowed, in many places. In order nevertheless to achieve a reduction in pressure in the external well casing, it is known to provide an additional pumping device, for example a further multiphase-pumping device, via which at least some of the natural gas in the external well casing is pumped off and fed to the actual feed flow, that is to say the crude-oil/natural-gas mixture, so that this mixture is then conveyed onward via the central multiphase-pumping device. The use of such an additional pumping device, however, involves very high outlay.

SUMMARY OF THE INVENTION

The invention is based on the problem of specifying an improved conveying device which makes it possible, on the one hand, to reduce the pressure in an external well casing in which a gas is conveyed and, on the other hand, to prevent burning off or flaring.

In order to solve this problem, the invention provides a conveying device for conveying a liquid/gas mixture, in particular a crude-oil/natural-gas mixture, taken from a borehole, having a multiphase-pumping device, which can be or is coupled to at least one feed line and a discharge line and to which the liquid/gas mixture can be fed, in the form of a feed flow, via the feed line and via which the mixture can be discharged under increased pressure, in the form of a conveyance flow, into the discharge line, and having a recirculation line, via which a sub-flow of the liquid contained in the conveyance flow can be returned to the feed flow, wherein the recirculation line contains an injector, through which the sub-flow can be conducted, with a negative pressure being generated in the process, and which can be or is coupled to at least one gas line, which conducts a gas, in particular natural gas, taken from the borehole.

The conveying device according to the invention comprises, first of all, a multiphase-pumping device, which in the installed state is connected to at least one feed line and to at least one discharge line. Via the feed line, the liquid/gas mixture which is fed via the central borehole line is taken in by suction and conveyed and conducted away via the discharge line. The liquid/gas mixture which is taken in by suction is therefore a feed flow, which is subject to a first pressure, for example ranging from 3-5 bar, whereas the liquid/gas mixture which is conducted away is a discharge flow, which is subject to a higher, second pressure, for example ranging from 30-35 bar, the pressure values being given merely by way of example.

A recirculation line returns a sub-flow of the liquid contained in the conveyance flow. Multiphase pumps usually involve such a return purely of a liquid-flow fraction directly to the multiphase pump so that the returned sub-flow, consisting of a small fraction, e.g. 3-5%, of the liquid contained in the conveyance flow, on the one hand, seals internal gaps within the multiphase pump, in order to prevent the gas from the liquid/gas mixture from escaping, and, on the other hand, cools the multiphase pump. According to the invention, then, a corresponding liquid fraction is returned to the feed flow via a recirculation line. According to the invention, an injector is incorporated in this recirculation line. This injector is consequently fed the returned sub-flow, the latter flowing through the injector. The injector has a nozzle arrangement with a decreasing cross section, so that the flow speed of the liquid or of the sub-flow increases in the region of the cross-sectional reduction. This is accompanied by a reduction in the pressure at the nozzle exit. That is to say that a negative pressure forms in the nozzle arrangement or the nozzle housing, in a manner corresponding to the Venturi effect. This negative pressure, then, is utilized according to the invention in order to remove by suction the natural gas in the external well casing. For this purpose, the injector is connected to a gas line, which in turn is connected to the external well casing. Since the injector, in turn, is coupled to the feed line, the natural gas removed by suction is fed to the conveyance flow in the feed line, that is to say the actual product line, and pumped off via the multiphase-pumping device. In the injector, or downstream of the injector, the gas removed by suction mixes with the sub-flow, that is to say the liquid, and this results, once again, in the formation of a liquid/gas mixture, which is fed to the feed line, in which a liquid/gas mixture is likewise being conveyed. The active suction removal of the natural gas via the injector makes it possible to reduce the pressure level in the external well casing to a pressure range significantly below the pressure of the conveyance flow, that is to say of the crude-oil/natural-gas mixture in the feed line (e.g. 0.5 bar (g)). The reduction in the gas pressure relieves pressure on the crude-oil reservoir, which in turn results in the liquid level in the well increasing, which in turn increases the conveyance rate.

Accordingly, the integration according to the invention of the injector, that is to say of the Venturi-nozzle arrangement, readily makes it possible, without integration of any expensive pumping device, to remove the natural gas by suction in a sufficient quantity with a sufficient reduction in pressure, for example an intake pressure of 0.5-1.5 bar, without a gas fraction having to be burnt off or flared. Since it is ultimately contained in the feed flow, the natural gas removed by suction can be pumped and later separated and fed for further utilization. Such an injector is a straightforwardly designed, fluid-mechanics component, and all that is required is for the corresponding nozzle arrangement, along with nozzle housing, and also corresponding connections for the respective lines to be provided. Accordingly, the conveying device according to the invention is extremely straightforward in terms of design, but at the same time is also extremely efficient.

In a development of the invention, the multiphase-pumping device can have arranged downstream of it a separator device, to which the recirculation line is coupled. The mixture conveyed via the multiphase-pumping device, that is to say the conveyance flow, is fed to the separator, wherein phase separation takes place in the separator device, that is to say that the liquid phase is separated from the gaseous phase, in this case therefore crude oil is separated from natural gas. The crude oil can then be returned as a fraction, in the form of a sub-flow, via the recirculation line, the latter being connected to the separator device, and fed either in full or also just as a fraction to the injector, which will be explained below.

The recirculation line can have a first line portion, which is coupled to the multiphase-pumping device and via which a first sub-flow fraction can be fed to the multiphase-pumping device. The recirculation line can also have a second line portion, which can be or is coupled to the injector and via which a second sub-flow can be fed to the injector. Accordingly, a corresponding sub-flow is drawn off, for example from the separator device, in order to be recirculated. However, for example not the entire sub-flow is fed to the injector; rather the sub-flow is split into two sub-flow fractions, wherein one sub-flow fraction is fed directly to the multiphase-pumping device, whereas the other sub-flow fraction is fed to the injector and flows through the same, generating the negative pressure in the process, whereupon the sub-flow fraction is fed once again to the feed flow. As an alternative, however, it is also possible for the entire sub-flow to be fed to the injector, depending on the quantity of gas to be removed by suction via the injector.

In a development of the invention, a throttle valve can be provided in the recirculation line or in the first and in the second line portions. The or each throttle valve can be used to set the pressure in the respective line so that it is thereby possible to set the negative pressure being established in the injector, via which, in turn, it is possible to set the volume of natural gas taken in by suction as well as the corresponding reduction in pressure in the gas line. The gas pressure is preferably set to a value which is smaller than the pressure of the feed flow.

The conveying device according to the invention can be assigned to just one borehole. That is to say that to the multiphase-pumping device is connected up to just one feed line and the injector is connected up to just one gas line, these lines supplying the multiphase-pumping device and the injector, respectively. However, it is also conceivable for the feed line to be connected to a plurality of separate lines which are associated with different boreholes and conduct a liquid/gas mixture, and/or for the gas line to be connected to a plurality of separate lines which are associated with different boreholes and conduct gas. According to this variant of the invention, consequently, a plurality of separate mixing lines, coming from different boreholes, open out into the feed line, which is connected to the multiphase-pumping device. That is to say that a liquid/gas mixture taken from a plurality of boreholes or oil lines is conveyed via the common multiphase-pumping device. As an alternative, or in addition, it is also possible, in the same way, for the injector to serve a plurality of boreholes, or the gas lines thereof, and to remove gas by suction there since the gas line, which is connected to the injector, in turn, communicates with a plurality of separate lines which are assigned to the individual boreholes and conduct gas. That is to say that natural gas which is taken from a plurality of boreholes or external well casings is removed by suction via the common injector, the entire quantity of gas, in turn, being fed to the feed flow upstream of the multiphase-pumping device.

The injector itself has at least one first connection, to which the recirculation line is connected and which is followed, in a nozzle housing, by a nozzle with a constricted nozzle cross section, and also has at least one second connection, to which the gas line is connected and which opens out in the nozzle housing, wherein the nozzle housing is followed by a line which is connected to the feed line. The injector is therefore a straightforward component comprising a nozzle housing or a nozzle block, in which the Venturi nozzle is arranged. The Venturi nozzle is arranged downstream of a first connection, to which the recirculation line is connected, so that the sub-flow fed is fed directly to the nozzle. A second connection for the gas line is provided in the nozzle housing or on the nozzle block, and the gas line therefore opens out in the nozzle interior, that is to say in the region in which the negative pressure prevails, so that the negative pressure correspondingly can cause the natural gas to be taken in by suction. Via a line which is connected for example in the form of a separate pipe to the nozzle housing, the sub-flow which has exited from the nozzle and also the gas which has been taken in by suction are conducted onward in the form of a mixture and, finally, fed to the feed flow at a corresponding connection to the feed line.

In addition to the conveying device itself, the realization also relates to a method which is intended for conveying a liquid/gas mixture, in particular a crude-oil/natural-gas mixture, taken from a borehole and in which, by means of a multiphase-pumping device, which is coupled to a feed line and a discharge line, the liquid/gas mixture fed in the form of a feed flow via the feed line is conveyed under increased pressure, in the form of a conveyance flow, into the discharge line, wherein a recirculation line is used to return a sub-flow of the conveyance flow to the feed flow, wherein the sub-flow flows through an injector, which is provided in the recirculation line, this generating a negative pressure which causes a gas conducted in a gas line and taken from the borehole to be taken in by suction.

It is possible here according to the invention for the sub-flow to be taken from a separator device, which is arranged downstream of the multiphase-pumping device and to which the recirculation line is coupled.

It is conceivable for just one sub-flow to branch off from the conveyance flow and feed to the injector. This sub-flow can be branched off at a position arranged downstream of the multiphase-pumping device, or from the separator device. As an alternative, it is also conceivable for a first sub-flow fraction to be fed to the multiphase-pumping device via a first line portion of the recirculation line, while a second sub-flow fraction is fed to the injector via a second line portion. Accordingly, the two sub-flow fractions are fed to different units, namely in the one case to the multiphase-pumping device, in order to provide for gap sealing and cooling there, and in the other case to the injector.

Furthermore, the pressure at which the sub-flow or the sub-flow fraction is conveyed can be reduced via a throttle valve, which is provided in the recirculation line or in the first and in the second line portions, so that the respective flows can be divided up correspondingly.

It is possible, in principle, for the conveying device to serve just one borehole. That is to say that the liquid/gas mixture is taken from just one borehole and is fed, in the form of a feed flow, to the multiphase-pumping device, and that the gas is taken from just one external well casing and is fed, in the form of a gas flow, to the injector and is removed by suction via the same. As an alternative to this, however, it is also conceivable for the liquid/gas mixture to be fed in the form of a feed flow by a plurality of separate feed lines which are associated with a plurality of separate, different boreholes and are connected to the common feed line, which is coupled to the multiphase pump, and/or for the gas to be taken in by suction by a plurality of separate gas lines which are associated with a plurality of separate, different boreholes and are connected to the common gas line, which is coupled to the injector. Accordingly, the multiphase-pumping device consequently conveys the mixture, that is to say for example the crude-oil/natural-gas mixture, from a plurality of boreholes, as is the natural gas removed by suction from a plurality of boreholes via the injector. The conveying device comprising the multiphase-pumping device and the injector therefore serves a plurality of boreholes, which are coupled to the conveying device via corresponding line connections.

Use is expediently made of an injector which has a first connection, to which the recirculation line is connected and which is followed, in a nozzle housing, by a nozzle with a constricted nozzle cross section, and also has a second connection, to which the gas line is connected and which opens out in the nozzle housing, wherein the nozzle housing is followed by a line which is connected to the feed line.

The various features of novelty which characterize the invention are pointed out with particularity in the claims annexed to and forming a part of the disclosure. For a better understanding of the invention, its operating advantages, specific objects attained by its use, reference should be had to the drawings and descriptive matter in which there are illustrated and described preferred embodiments of the invention.

DETAILED DESCRIPTION OF THE INVENTION

Figure 1:
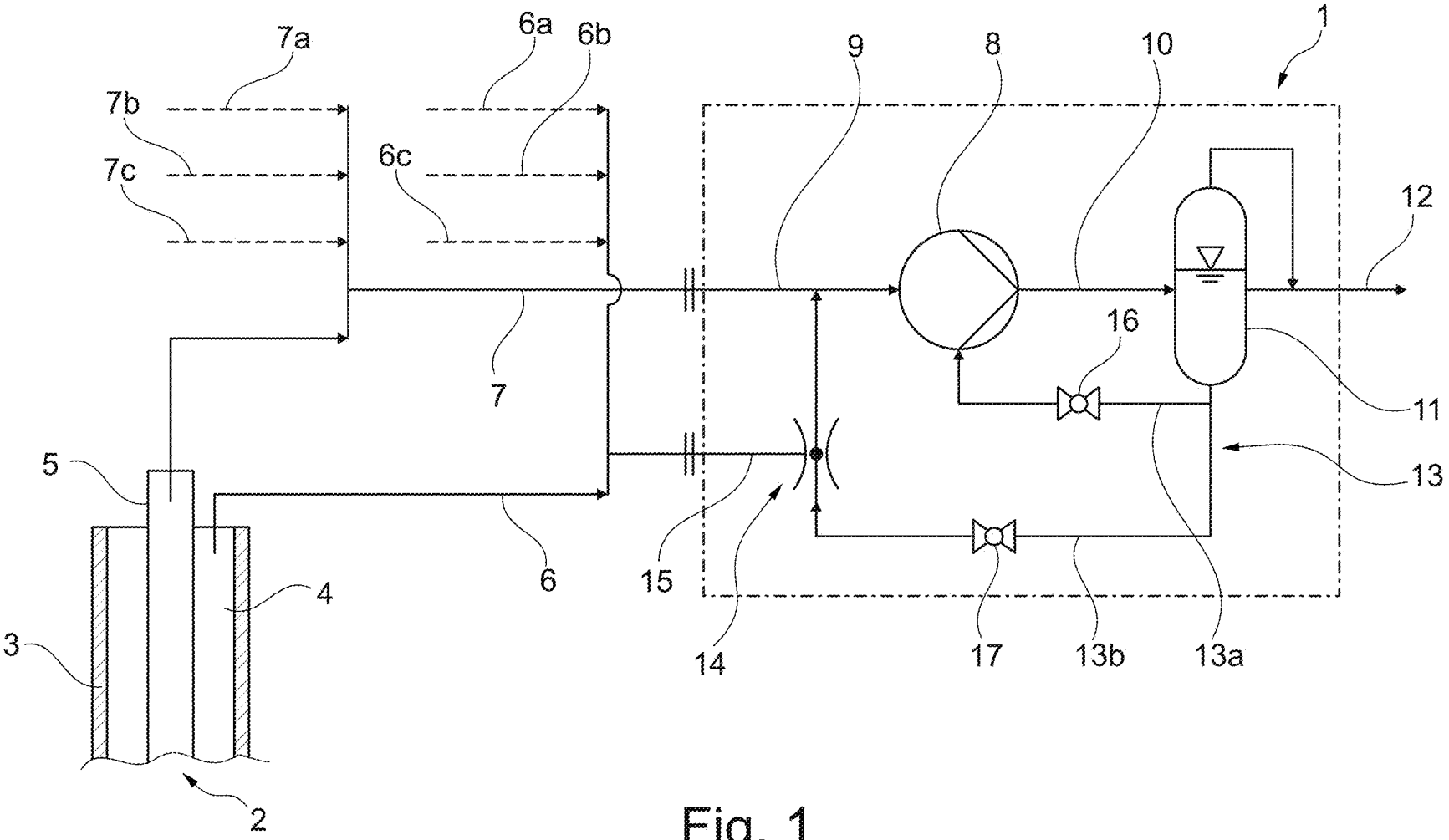
FIG. 1 shows a schematic diagram of a conveying device according to the invention coupled to a borehole.

FIG. 1 shows a schematic diagram of a conveying device 1 according to the invention, along with its essential functional components, which serves to convey a liquid/gas mixture taken from a borehole 2. The borehole 2 is realized by a well 3, having an external well casing 4 and an internal line 5. For example a crude-oil/natural-gas mixture is taken from the borehole 2, wherein a corresponding mixture of crude oil and natural gas with a predominant crude-oil fraction is conveyed in the line 5, whereas natural gas is drawn off in the external well casing 4. The conveying device 1 is suitably connected to the external well casing 4 and the line 5 via corresponding lines 6, 7.

The conveying device 1 has a multiphase-pumping device 8, which is connected via a feed line 9 to the line 7, which in turn is coupled to the line 5 of the borehole 2. Via the multiphase-pumping device 8, the liquid/gas mixture is taken in by suction in the form of a feed flow and conveyed onward at higher pressure, in the form of a conveyance flow, via a discharge line 10. The pressure on the suction side, that is to say the pressure of the feed flow, is for example 4-5 bar, whereas the pressure on the pressure side, that is to say the pressure of the conveyance flow, is for example 30-35 bar.

The multiphase-pumping device 8 has arranged downstream of it a separator device 11, in which phase separation takes place, i.e. a liquid flow is branched off there. The rest of the crude-oil/natural-gas mixture is fed to a pipeline 12.

Also provided is a recirculation line 13, which in the example shown is guided away from the separator device 11 or the appliance part in which the separated-off liquid, that is to say the crude oil/water, is present. It has a first line portion 13*a*, which leads directly to the multiphase-pumping device 8, so that a fraction of the sub-flow which is drawn off from the separator device 11, and contains just liquid, is fed directly to the multiphase-pumping device 8, in order to provide, via this returned liquid fraction, for gap sealing and pressure build-up and cooling there. The recirculation line 13 also has a second line portion 13*b*, which serves for the feed line 9, so that a further sub-flow fraction which is conducted in the line portion 13*b*, and contains only liquid, is returned to the feed flow again.

An injector 14 is incorporated in the second line portion 13*b*, the sub-flow fraction being fed to the injector and guided through the same before being mixed in with the feed flow again. This injector 14, in turn, is connected to a gas line 15, which for its part is connected to the line 6, via which the natural gas is drawn off out of the external well casing 4. The injector 14 has—and this will be discussed in more detail hereinbelow—a nozzle arrangement, through which the sub-flow fraction flows, so that a negative pressure is generated in the injector, the negative pressure causing the natural gas to be sucked out of the external well casing 4 via the gas line 15 and the line 6. This reduces the pressure in the external well casing 4 and therefore the pressure to which the crude-oil reservoir is subjected, which makes possible an increase in the conveyance quantity.

This results in the formation, in the injector, of a mixture of the sub-flow fraction, that is to say of a purely liquid phase, and the natural gas taken in by suction, that is to say of a gaseous phase, so that the feed flow in the feed line 9, once again, is fed a liquid/gas mixture or, specifically, a crude-oil/natural-gas mixture. The two sub-flows, that is to say the actual feed flow and the flow coming from the injector 14, are then pumped once again via the multiphase-pumping device 8.

As FIG. 1 also shows, the two line portions 13*a*, 13*b* contain two throttle valves 16, 17, via which it is possible to set a setting of the volume fraction of the respective sub-flow fraction conveyed in the line portion 13*a*, 13*b*, depending on the pressure at which the respective sub-flow fraction is to be fed, on the one hand, to the multiphase-pumping device 8 and, on the other hand, to the injector 14.

FIG. 1 also shows the possibility of the conveying device 1 according to the invention, rather than serving just one borehole 2, serving further boreholes 2, of which, in the example shown, the respective lines 6*a*, 6*b*, 6*c* which conduct gas, and via which the natural gas is respectively removed by suction, and also the lines 7*a*, 7*b*, 7*c* which conduct a liquid/gas mixture, and via which the crude oil is respectively pumped off, are shown. The lines 6, 6*a*, 6*b*, 6*c* and 7, 7*a*, 7*b*, 7*c* are bundled and connected to the gas line 15 and the feed line 9, respectively, so that the multiphase-pumping device 8 can therefore be used to pump off crude oil from a plurality of boreholes 2, as can the injector 14 be used to remove natural gas by suction from a plurality of boreholes 2 or external well casings.

Figure 2:
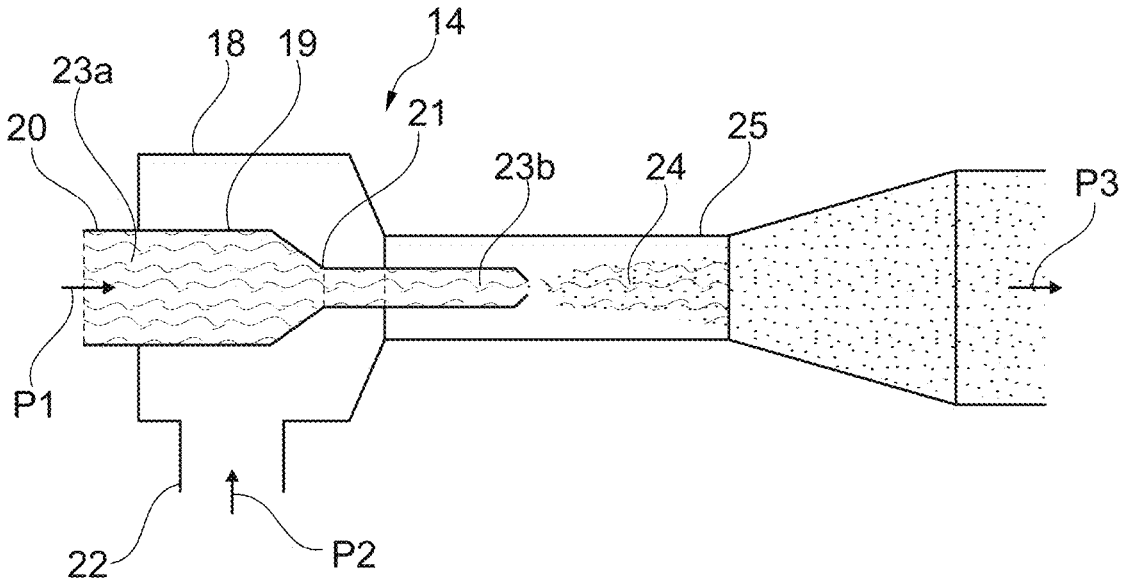
FIG. 2 shows a schematic diagram of an injector.

FIG. 2 shows a schematic diagram of the injector 14. The figure shows a nozzle housing 18, which accommodates a nozzle 19 of decreasing cross section. The nozzle housing 18 has a first connection 20, to which in the example according to FIG. 1 the line portion 13*b* is connected, so that the sub-flow fraction 23*a*, as shown by the arrow P1, is fed directly to the nozzle 19. The liquid sub-flow 23*b*, that is to say the crude oil taken for example according to FIG. 1 from the separator device 11, exits at the nozzle exit 21, which has a considerably reduced cross section, the flow speed of this liquid sub-flow having increased, but its pressure having decreased, so that a negative pressure is established in the interior of the nozzle housing 18.

The nozzle housing 18 has a second connection 22, to which in the example shown according to FIG. 1 the gas line 15 is connected. The negative pressure prevailing in the interior of the nozzle housing 18 causes natural gas to be taken in by suction via the gas line 15, as shown by the arrow P2, and this results in a pressure reduction in the external well casing and therefore in the deposit itself. The natural gas taken in by suction mixes with the crude-oil sub-flow fraction 23*b*, and this results in the formation of a crude-oil/natural-gas mixture 24, as illustrated in FIG. 2. In a continuing line 25, which can widen in cross section, the crude-oil/natural-gas mixture 24 flows onward—as is illustrated by the arrow P3—until the mixture 24, at an interface to the feed line 9, is mixed in with the actual feed flow. Depending on the ratios of the cross section of the nozzle 19 and of the pressure at which the sub-flow fraction 23*a* is fed, a higher or lower negative pressure is established, that is to say that the design of this Venturi-nozzle arrangement can set the suction-intake operation correspondingly.

Figure 3:
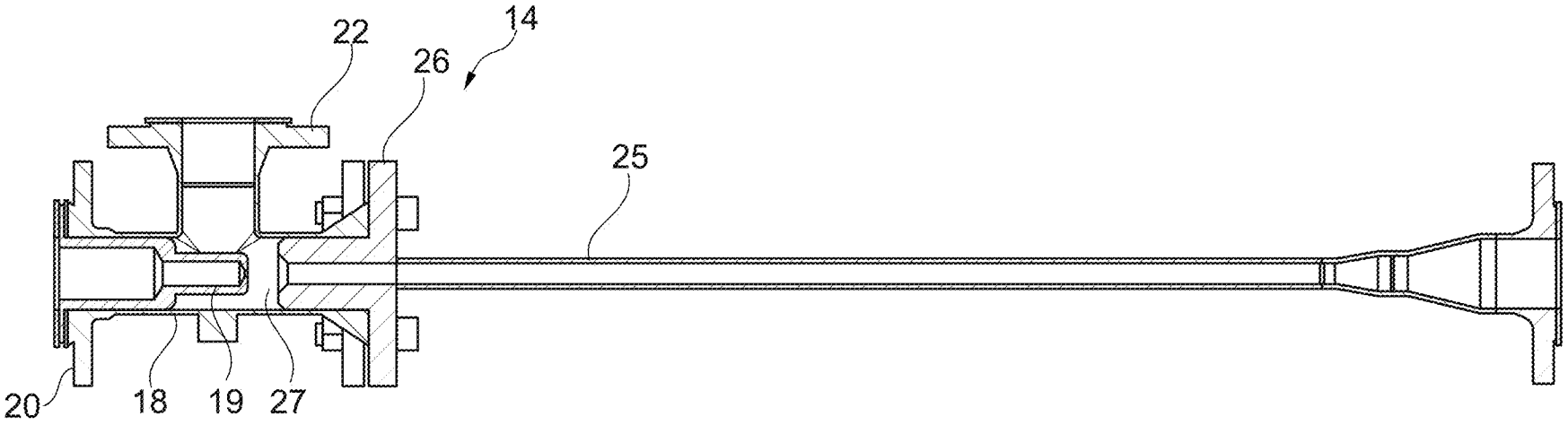
FIG. 3 shows a schematic diagram, in section, of one embodiment of an injector.

FIG. 3 shows a sectional view of one embodiment of the injector 14. The figure shows the nozzle housing 18 with the nozzle 19 and the two connections 20, 22, which are designed in the form of corresponding connection flanges and in the example shown are located orthogonally in relation to one another. The figure also shows the line 25, which is connected to the nozzle housing 18 via a flange connection 26. The line 25 communicates with the interior 27 of the nozzle housing 18, in which forms the crude-oil/natural-gas mixture 24, which is conducted away via the line 25.

The embodiment of the injector 14 shown is merely by way of example; other designs are, of course, conceivable, as long as they provide for the suction-intake operation according to the invention.

While specific embodiments of the invention have been shown and described in detail to illustrate the inventive principles, it will be understood that the invention may be embodied otherwise without departing from such principles.

I claim:

1. A conveying device for conveying a liquid/gas mixture taken from a borehole, comprising: a feed line; a discharge line; a multiphase-pumping device coupled to the feed line and the discharge line and to which the liquid/gas mixture is fed as a feed flow via the feed line and via which the liquid/gas mixture is discharged under increased pressure as a conveyance flow into the discharge line; a recirculation line, via which a sub-flow of liquid contained in the conveyance flow is returned to the feed flow, wherein the recirculation line contains an injector, through which the sub-flow is conducted so that a negative pressure is generated; and a gas line coupled to the injector so that the gas line conducts a gas taken from the borehole by suction generated by the negative pressure.

2. The conveying device according to claim 1, wherein the multiphase-pumping device has arranged downstream of it a separator device, to which the recirculation line is coupled.

3. The conveying device according to claim 1, wherein the recirculation line has a first line portion, which is coupled to the multiphase-pumping device and via which a first sub-flow fraction can be fed to the multiphase-pumping device, and has a second line portion, which is coupled to the injector and via which a second sub-flow fraction can be fed to the injector.

4. The conveying device according to claim 1, wherein a throttle valve is provided in the recirculation line or in the first and in the second line portions.

5. The conveying device according to claim 1, wherein the feed line is connected to a plurality of separate lines which are associated with different boreholes and conduct a liquid/gas mixture, and/or in that the gas line is connected to a plurality of separate lines which are associated with different boreholes and conduct gas.

6. The conveying device according to claim 1, wherein the injector has a first connection, to which the recirculation line is connected and which is followed, in a nozzle housing, by a nozzle with a constricted nozzle cross section, and also has a second connection, to which the gas line is connected and which opens out in the nozzle housing, wherein the nozzle housing is followed by a mixing line, which is connected to the feed line.

7. A method for conveying a liquid/gas mixture taken from a borehole, the method comprising the steps of: conveying, via a multiphase-pumping device is coupled to a feed line and a discharge line, the liquid/gas mixture, which is fed as a feed flow via the feed line, under increased pressure as a conveyance flow into the discharge line; using a recirculation line to return a sub-flow of the conveyance flow to the feed flow; and generating a negative pressure by passing the sub-flow through an injector provided in the recirculation line whereby the negative pressure causes a gas to be taken from the borehole by suction and conducted in a gas line.

8. The method according to claim 7, wherein the sub-flow is taken from a separator device, which is arranged downstream of the multiphase-pumping device and to which the recirculation line is coupled.

9. The method according to claim 7, wherein a first sub-flow fraction is fed to the multiphase-pumping device via a first line portion of the recirculation line, and a second sub-flow fraction is fed to the injector via a second line portion.

10. The method according to claim 7, wherein the pressure at which the sub-flow or a sub-flow fraction is conveyed is reduced via a throttle valve, which is provided in the recirculation line or in the first and in the second line portions.

11. The method according to claim 7, wherein the liquid/gas mixture is fed in the form of a feed flow by a plurality of separate lines which conduct a liquid/gas mixture, are associated with a plurality of separate, different boreholes and are connected to the common feed line, which is coupled to the multiphase pump, and/or in that the gas is taken in by suction by a plurality of separate lines which conduct gas, are associated with a plurality of separate, different boreholes and are connected to the common gas line, which is coupled to the injector.

12. The method according to claim 7, wherein use is made of an injector which has a first connection, to which the recirculation line is connected and which is followed, in a nozzle housing, by a nozzle with a constricted nozzle cross section, and also has a second connection, to which the gas line is connected and which opens out in the nozzle housing, wherein the nozzle housing is followed by a line which is connected to the feed line.

13. The conveying device according to claim 1, wherein the liquid/gas mixture is a crude-oil/natural-gas mixture.

14. The method according to claim 7, wherein the liquid/gas mixture is a crude-oil/natural-gas mixture.

* * * * *